United States Patent [19]

Poirier et al.

[11] Patent Number: 4,529,504

[45] Date of Patent: Jul. 16, 1985

[54] REMOVAL OF NITROGENOUS COMPOUNDS FROM PETROLEUM PROCESSING PRODUCTS USING CHLOROSILYLATED SILICA GEL

[75] Inventors: Marc-André Poirier, Ottawa; Albert E. George, Kanata, both of Canada

[73] Assignee: Canadian Patents and Development Limited-Societe Canadienne Des Brevets et D'Exploitation Limitee, Ottawa, Canada

[21] Appl. No.: 578,658

[22] Filed: Feb. 9, 1984

[30] Foreign Application Priority Data

Feb. 10, 1983 [CA] Canada ..... 421286

[51] Int. Cl.[3] ..... C10G 25/00; C10G 25/05

[52] U.S. Cl. ..... 208/254 R; 208/307; 502/233

[58] Field of Search ..... 208/254 R, 307

[56] References Cited

U.S. PATENT DOCUMENTS

| | | | |
|---|---|---|---|
| 1,992,979 | 3/1935 | Wollner | 208/307 |
| 2,378,290 | 6/1945 | Drake et al. | 502/236 |
| 2,552,436 | 5/1951 | Bennett et al. | 208/307 |
| 2,763,603 | 9/1956 | Skinner | 208/254 R |
| 2,879,228 | 3/1959 | Holeton | 208/307 |
| 2,943,049 | 6/1960 | Nahin et al. | 208/307 |
| 3,005,826 | 10/1961 | Fleck et al. | 208/254 R |
| 3,055,825 | 9/1962 | Buningh et al. | 208/254 R |
| 3,893,912 | 7/1975 | Zimmerman | 208/307 |

FOREIGN PATENT DOCUMENTS

| | | | |
|---|---|---|---|
| 1113998 | 1/1959 | Fed. Rep. of Germany | 208/254 R |
| 1565928 | 8/1977 | U.S.S.R. | 208/254 R |
| 1565858 | 8/1977 | U.S.S.R. | 208/254 R |
| 0597709 | 3/1978 | U.S.S.R. | 208/254 R |

*Primary Examiner*—D. E. Gantz
*Assistant Examiner*—Helane Myers
*Attorney, Agent, or Firm*—Fisher, Christen & Sabol

[57] ABSTRACT

A process is described for removing both high polar and neutral nitrogen compounds from petroleum processing liquid products and petroleum distillate fractions. According to the novel feature, a chlorosilylated silica gel is used as adsorbent for the nitrogen compounds. This adsorbent has been found to be superior to regular silica gel and commercial ion exchange resins for removing particularly the neutral nitrogen compounds.

5 Claims, No Drawings

REMOVAL OF NITROGENOUS COMPOUNDS FROM PETROLEUM PROCESSING PRODUCTS USING CHLOROSILYLATED SILICA GEL

This invention relates to a process for removing nitrogen compounds from hydrocarbon oils. More particularly, it relates to a process for removing dissolved organic nitrogen compounds from heavy hydrocarbon oils and their processing products.

Almost all petroleum crude oils contain small amounts of various nitrogenous compounds which are found in varying concentrations in the fractions and products produced from such crudes. Hydrocarbonaceous liquids obtained from heavy hydrocarbons oils such as bitumen and heavy oils contain relatively high quantities of nitrogen in various forms, and especially five and six member cyclic compounds such as pyridines and indoles. These nitrogenous compounds are detrimental because they cause catalyst deactivation, lower product quality and tend to be difficult to remove.

Commercial ion exchange resins have been used for the separation of acidic and basic nitrogenous compounds from hydrocarbon mixtures. For instance, U.S. Pat. No. 3,005,826 describes the use of a silica gel adsorbent for removing basic organic nitrogen components. Other adsorbents for this purpose are described in U.S. Pat. No. 3,055,825. A major problem with the commercial ion exchange resins is that they are relatively expensive and do not tend to bond to neutral nitrogenous compounds. The latter are separated by ferric chloride adsorbed on clay, which is not totally selective for this purpose and forms complexes with polynuclear aromatic hydrocarbons. Metallic halides such as $TiCl_4$ and $SnCl_4$ have also been reported to form complexes with nitrogenous compounds.

According to the present invention it has been found that a chlorosilylated silica gel is a highly effective adsorbent for the removal of nitrogenous compounds from petroleum processing liquid products as well as petroleum distillate fractions. This material has been found to be more effective for removing nitrogen from petroleum liquid products than the commercial ion exchange resins.

The chlorosilylation of silica can be carried out using silicon tetrachloride according to the procedure of Locke, D.C. et al (Anal. Chem., 44, 90 (1972)). In this procedure silicon tetrachloride was slowly added to silica gel and mixed under reflux. Thereafter, any excess silicon tetrachloride was removed with a solvent, leaving chlorosilylated silica gel. Titanium tetrachloride may also be used for this purpose.

The optimum particle size for the chlorosilylated silica gel adsorbent will depend upon the manner in which it is used in the process, i.e., as a fixed compact bed, a fluidized bed, etc., but is usually between about 2 and about 400 mesh.

The nitrogen-containing liquid hydrocarbons may be contacted with the silylated silica gel in either the vapor or liquid phase. The pressure is usually near atmospheric, but may be either subatmospheric or superatmospheric. The adsorption may be carried out at moderate temperatures and typically at room temperature.

The invention may be more readily understood from the following illustrative examples.

EXAMPLE 1

A. A chlorosilylated silica gel was prepared using as a starting material Silica Gel Grade H, a 20–200 mesh silica gel available from Davison Chemical Ltd. This material was activated overnight at 230° C. and 10 grams of the activated silica gel had 22 grams silicon tetrachloride slowly added thereto. This mixture was then stirred under reflux for 2 hours. The slurry obtained was poured into a glass chromatography column plugged with glass wool and the excess silicon tetrachloride reagent was eluated with 100 mL of pentane, the residual pentane being flushed from the column with a nitrogen stream.

B. A synthetic nitrogenous compound mixture was prepared containing both neutral and basic nitrogenous compounds. This mixture had the following properties:

TABLE 1

| Synthetic Mixture of Nitrogenous Compounds | B.P. (°C.) | Mol. Wt. |
|---|---|---|
| Neutral Nitrogenous Compounds | | |
| 1. 2,5-dimethylpyrrole | 163 | 95 |
| 2. 1,2,5-trimethylpyrrole | 173 | 109 |
| 3. Quinoxaline | 220 | 130 |
| 4. Indole | 253 | 117 |
| 5. Tetrahydrocarbazole | 326 | 171 |
| 6. Carbazole | 355 | 167 |
| 7. Phenothiazine | 371 | 199 |
| Total Nitrogen Content = 580 ng/μl | | |
| Basic Nitrogenous Compounds | | |
| 8. 3-methylpiperidine | 125 | 99 |
| 9. Indoline | 220 | 119 |
| 10. 4-phenylpyridine | 274 | 155 |
| 11. N—phenylpiperazine | 286 | 162 |
| 12. p-aminodiphenylmethane m.p. | 34 | 183 |
| 13. 2-aminofluorene m.p. | 129 | 181 |
| 14. 1,5-diaminonaphthalene m.p. | 185 | 158 |
| Total Nitrogen Content = 355 ng/μl | | |

C. Three extraction columns were set up, one containing regular silica gel, one containing Amberlyst A-29® and Amberlyst A-15® and the third column containing the chlorosilylated silica gel of the present invention. Each column was packed with 10 grams of sorbent material.

120 mL of synthetic nitrogenous compound mixture was percolated through each column and eight fractions of the eluate were collected (two-5 mL and six-10 mL fractions) and analyzed for nitrogen. Results of nitrogen removal were compared and are shown in Table 2 below:

TABLE 2

Comparison of Ion Exchange Resins, Silica and Silylated Silica for Removing Nitrogenous Compounds from Synthetic Mixtures*

| | | % Neutral Nitrogen Removal | |
|---|---|---|---|
| Fraction | Ion Exchange Resins | Silica | Silylated Silica |
| 1 | Neutral nitrogenous | 100.0 | 100.0 |
| 2 | compounds not | 99.0 | 99.0 |
| 3 | retained | 96.2 | 96.2 |
| 4 | | 82.2 | 85.8 |
| 5 | | 72.2 | 76.8 |
| 6 | | 65.0 | 76.6 |
| 7 | | 57.7 | 76.6 |
| 8 | | 46.7 | 75.5 |

*Basic nitrogenous compounds were removed completely from all fractions on the 3 columns

EXAMPLE 2

A coker kerosene was obtained from the Great Canadian Oil Sands plant and had the following properties:

TABLE 3

| Typical Properties of Coker Kerosene | |
|---|---|
| Boiling range, °C. | 193–279 |
| Specific Gravity, 60/60° F. | 0.871 |
| Sulphur, wt % | 2.32 |
| Nitrogen, ppm | 430 |
| Pour Point, °F. | Below −60 |
| Cloud Point, °F. | Below −60 |
| Flash Point, °F. | 116 |
| Vanadium, ppm | 0.40 |
| Nickel, ppm | 0.36 |
| Iron, ppm | 0.50 |
| Ramsbottom Carbon Residue wt. % (10% bottoms) | 0.29 |
| Aromatics and Olefins, vol % | 58 |
| Saturates, vol % | 42 |

Two columns were used, one containing 10 grams of silica gel and the other containing 10 grams of the chlorosilylated silica gel of the present invention. 70 mL of the coker kerosene was percolated through each column and each column was then eluted with 20 mL of pentane and 100 mL of benzene. The benzene fraction was evaporated under slight vacuum and analyzed for nitrogen. The results are shown below:

TABLE 4

| Comparison of Ion Exchange Resins and Silylated Silica for Removal of Nitrogenous Material from Coker Kerosene | | |
|---|---|---|
| | % Total Nitrogen Removal | |
| Fraction | Ion Exchange Resins | Silylated Silica |
| 1 | 97.5 | 100.0 |
| 2 | 96.0 | 99.7 |
| 3 | 92.4 | 99.3 |
| 4 | 88.5 | 96.5 |
| 5 | 84.5 | 91.1 |
| 6 | 80.0 | 87.6 |
| 7 | 77.5 | 79.5 |
| 8 | 75.0 | 73.0 |

From the results of the above examples, it will be seen that the basic nitrogenous compounds in the mixtures were retained on all three materials. This type of compound bonds to cationic exchange resin and because of its relatively high polarity is easily adsorbed on silica gel. The formation of colored bands on the silylated silica gel column indicates the occurrence of the formation of complexes.

While the neutral nitrogenous components were not retained, as expected, on the ion exchange resins, they were removed to a higher extent on the chlorosilylated silica gel than on the parent silica gel. The apparent high retention of the neutral nitrogenous components in the first four fractions from silica gel is explained by the slow migration of these compounds through the sorbent material. The higher retention of the neutral nitrogenous compounds on the chlorosilylated silica gel is caused by the formation of complexes. The fact that less nitrogenous material was desorbed by benzene from the chlorosilylated silica gel than the silica gel columns is further evidence for the occurrence of a complex with the chlorosilylated material.

The chlorosilylated silica gel was also more efficient than the commercial ion exchange resins for removing nitrogenous compounds from coker kerosene. This difference can be attributed to the neutral nitrogenous components which do not bond to the commercial resins.

We claim:

1. A process for removing dissolved organic nitrogen compounds from liquid hydrocarbons, which comprises contacting the liquid hydrocarbons with particles of chlorosilylated silica gel adsorbent whereby both high polar and neutral nitrogen compounds are removed from the liquid hydrocarbons and separating the hydrocarbons from the adsorbent.

2. The process according to claim 1 wherein the liquid hydrocarbons are petroleum processing liquid products.

3. The process according to claim 2 wherein the liquid hydrocarbons are obtained from processing bitumen or heavy oils.

4. The process according to claim 1 wherein the liquid hydrocarbons are petroleum distillate fractions.

5. The process according to claim 1 wherein the chlorosilylated silica gel is obtained by reacting particles of silica gel with silicon or titanium tetrachloride.

* * * * *